United States Patent [19]

Cicin-Sain

[11] Patent Number: 4,706,395

[45] Date of Patent: Nov. 17, 1987

[54] BALLAST DRESSING UNIT ON MACHINES WHICH DRESS AND RE-DISTRIBUTE RAILWAY ROAD BED BALLAST

[75] Inventor: Ivo Cicin-Sain, Bussigny-Laus., Switzerland

[73] Assignees: Danieli & C. Officine Meccaniche SpA; ITI/CLM Impianti Technici Industriali SpA, both of Buttrio, Italy

[21] Appl. No.: 736,771

[22] Filed: May 22, 1985

[30] Foreign Application Priority Data

Jun. 7, 1984 [IT] Italy ..... 83363 A/84

[51] Int. Cl.[4] ..... E02F 5/22

[52] U.S. Cl. ..... 37/105; 171/16

[58] Field of Search ..... 37/104, 105, 96; 171/16

[56] References Cited

U.S. PATENT DOCUMENTS

| | | | |
|---|---|---|---|
| 3,007,264 | 11/1961 | Stanton | 37/104 |
| 3,579,873 | 5/1971 | Kershaw | 37/105 |
| 3,706,145 | 12/1972 | Bucksch et al. | 37/105 |

FOREIGN PATENT DOCUMENTS

| | | |
|---|---|---|
| 359112 | 10/1980 | Austria . |
| 0061227 | 3/1982 | European Pat. Off. . |
| 92886 | 11/1983 | European Pat. Off. . |
| 1243227 | 12/1967 | Fed. Rep. of Germany . |
| 1938890 | 7/1969 | Fed. Rep. of Germany . |
| 550282 | 3/1972 | Switzerland . |
| 600043 | 6/1977 | Switzerland . |

*Primary Examiner*—Edgar S. Burr
*Assistant Examiner*—Moshe I. Cohen
*Attorney, Agent, or Firm*—Wegner & Bretschneider

[57] ABSTRACT

Ballast dressing unit (17) on machines (10) which dress and re-distribute railway road bed ballast, such unit (17) comprising at least one rotary dressing drum (23–24).

7 Claims, 5 Drawing Figures

BALLAST DRESSING UNIT ON MACHINES WHICH DRESS AND RE-DISTRIBUTE RAILWAY ROAD BED BALLAST

This invention concerns a ballast dressing unit on machines which dress and re-distribute railway road bed ballast. To be more exact, the invention concerns a dressing unit for self-propelled machines suitable for operations of flattening and shaping railway ballast.

As is known, upkeep of the road bed ballast entails flattening and/or shaping work, particularly at the portions of ballast at the sides of the rails. It also involves transfer of metalling from one side of the line to the other and to and from the middle of the line.

Various machines are known in the art which are intended to perform operations of dressing and adjusting the ballast. For instance, machines are known which comprise lateral ploughs to form the edges of the ballast.

These machines have also a system of orientable frontal ploughs through which the metalling can be transferred from one side of the line to the other.

A machine is known which is the subject of European patent application EP-A-0061227 and comprises on its lower side a system of ploughs to dress the ballast, and also an elevator belt in a central position to lift the metalling.

EP-A-0092886 discloses dressing equipment for ballast with rotary dressing drums. These rotary drums are fitted to arms which can be retracted within the maximum overall bulk permitted for travelling purposes. The drums cannot be adjusted as regards their inclination in relation to the arms and serve only to dress the outer flat portion of the ballast, whereas the sloped portion of the ballast is dressed by means of ploughs positioned at the lower part of the arms. Brushes are also included to clean the area of the rails.

DE-A-1938890 discloses a machine which has on each side an orientable lateral plough cooperating with a chute that passes over the rails, and with a bladed transfer device located above the chute. This text deals essentially with a device to transfer metalling from the sides towards the middle of the line.

U.S. Pat. No. 3,579,873 discloses a machine able to work on rails and able also to move on roads, this machine having frontal ploughs and lateral disk ploughs for the upkeep of the road bed. It includes at its rear end a brush for final cleaning. This machine does not comprise scarifiers nor bladed rotary drums and is based wholly on the principle of a plough.

CH-A-600043 discloses a dressing machine with frontal ploughs and with lateral ploughs which can be adjusted in height, inclination and lateral opening. A finishing brush is also comprised.

CH-A-550282 discloses a dressing machine with frontal ploughs and with lateral tracked scarifiers which can be adjusted in height and inclination. It also includes a rear brush.

DE No. 1243227 discloses a machine with transverse and lengthwise brushes and with means (5) able to compact the ballast.

U.S. Pat. No. 3,007,264 discloses a machine with brushes located between and outside the rails. This machine serves essentially to take excess metalling by means of chains with buckets cooperating with the brushes.

Patent AT-A-359.112 concerns a machine to transfer ballast, the machine being equipped with a system of movable ploughs which can be displaced so as to form suitable channels to convey metalling below the machine itself. The lateral ploughs are positioned behind the central ploughs and it is therefore impossible to transfer metalling and flatten the ballast in one single pass.

It is a purpose of our present invention to provide a ballast dressing unit which works according to new criteria with an efficiency which cannot be obtained with traditional dressing ploughs.

The present invention has the objective of accomplishing the dressing and transfer operations in one single pass with great efficiency and operating simplicity in cooperation with suitable means to re-distribute the metalling.

The ballast dressing machine to which the invention is applied comprises three separate work units. The first work unit of the machine according to the invention comprises two rotary lateral dressing drums instead of the traditional shaping ploughs. In a preferred embodiment these drums have different diameters.

The one of the two drums which has the smaller diameter is intended, in fact, to work between two railway lines at the same time as the other drum works on the outer side of one of such lines, and is intended to do so without protruding outside the maximum overall working bulk for its zone of action permitted by the regulations, the purpose being to obviate any disturbance of traffic on the neighbouring line.

Instead, in the case of a single railway line the drums may have the same diameter as each other.

This dressing unit may possibly be equipped with a set of interchangeable drums having different diameters.

The two drums can be oriented to suit the profile which is to be imparted to the side of the road bed.

The drums themselves can be raised to adjust the height of the ballast and can also be turned upside down in position for movement to another area. In such position the whole assemblage consisting of the drums and relative support arms does not protrude outside the maximum overall bulk laid down in the regulations.

Such drums are equipped advantageously with means, such as blades or the like, to engage the metalling. In a preferred embodiment such blades can orient themselves according to the direction of rotation of the drum, the purpose being to obtain engagement of the metalling in the best possible manner, with a centrifugal effect intended to prevent retention of the metalling by the drum itself.

Such rotary drums may be partially enclosed within casings or bodies so as to prevent the metalling being thrown outwards and an excessive quantity of dust being produced.

A second work unit is comprised in a position substantially at the centre of the machine. This unit is a central unit to re-distribute metalling and includes in a preferred embodiment two ploughs or shares, each of which is positioned at a side of a machine and cooperates with a rotary transfer drum.

Such drum, by rotating in one direction or the other, causes transfer of metalling from one or the other side of the line.

At the rear end of the machine is a large brush to dress the ballast and to clean the sleepers and attachments. This brush may be linked in the central portion of the machine to an auxiliary rotary brush that lifts the metalling or to a central plough that lifts the metalling. Such plough may possibly and advantageously be adjustable in height so that it can be adapted to various types of sleepers, including the bi-block type.

This invention is therefore embodied in a ballast dressing unit on machines which dress and re-distribute railway road bed ballast, such unit being characterised in that it comprises at least one rotary dressing drum.

We shall now describe a preferred embodiment of the invention as a non-restrictive example with the help of the attached figures, in which.

Figure 1:
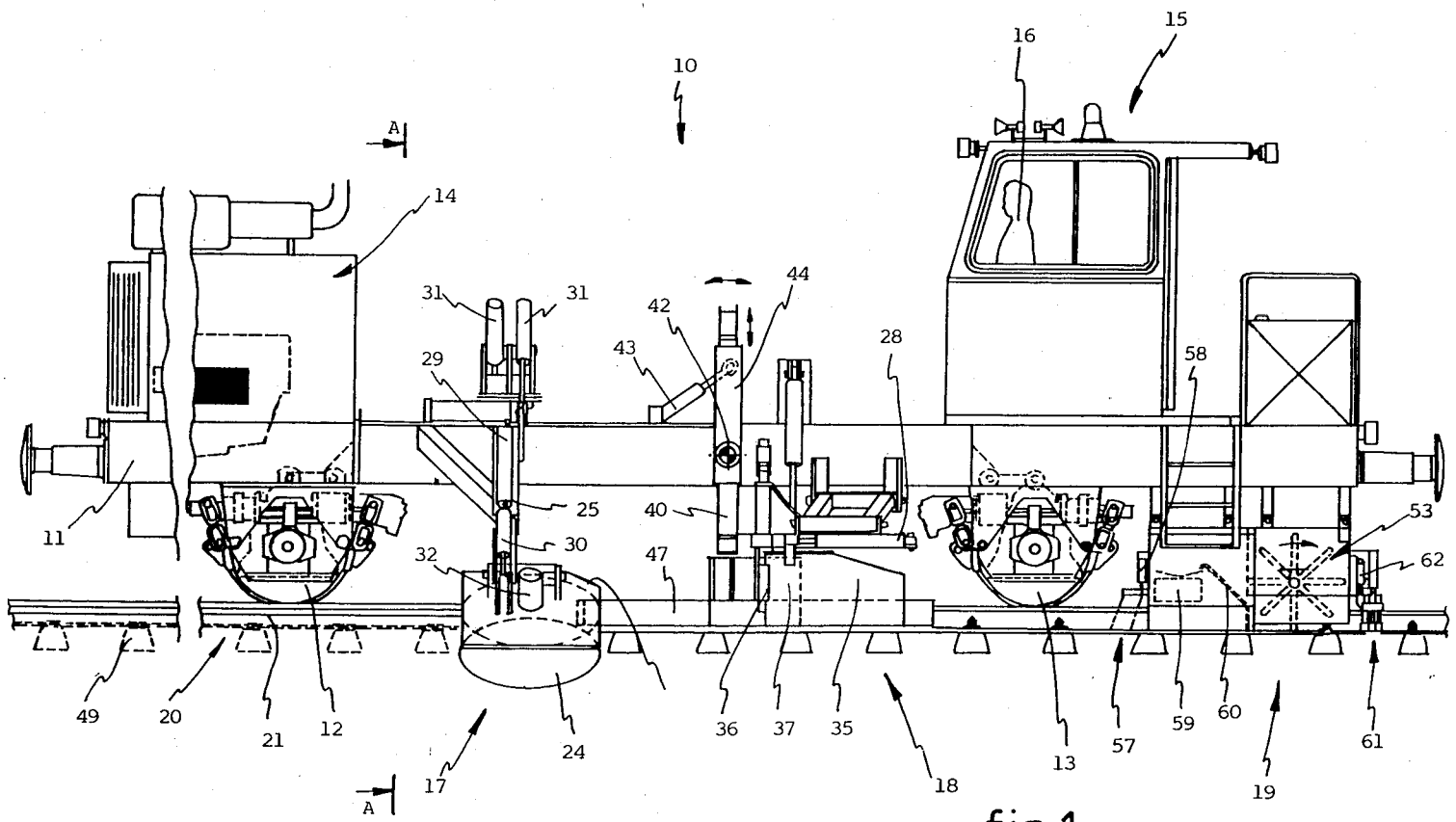
FIG. 1 is a side view of a ballast dressing machine that employs the invention.
Figure 2:
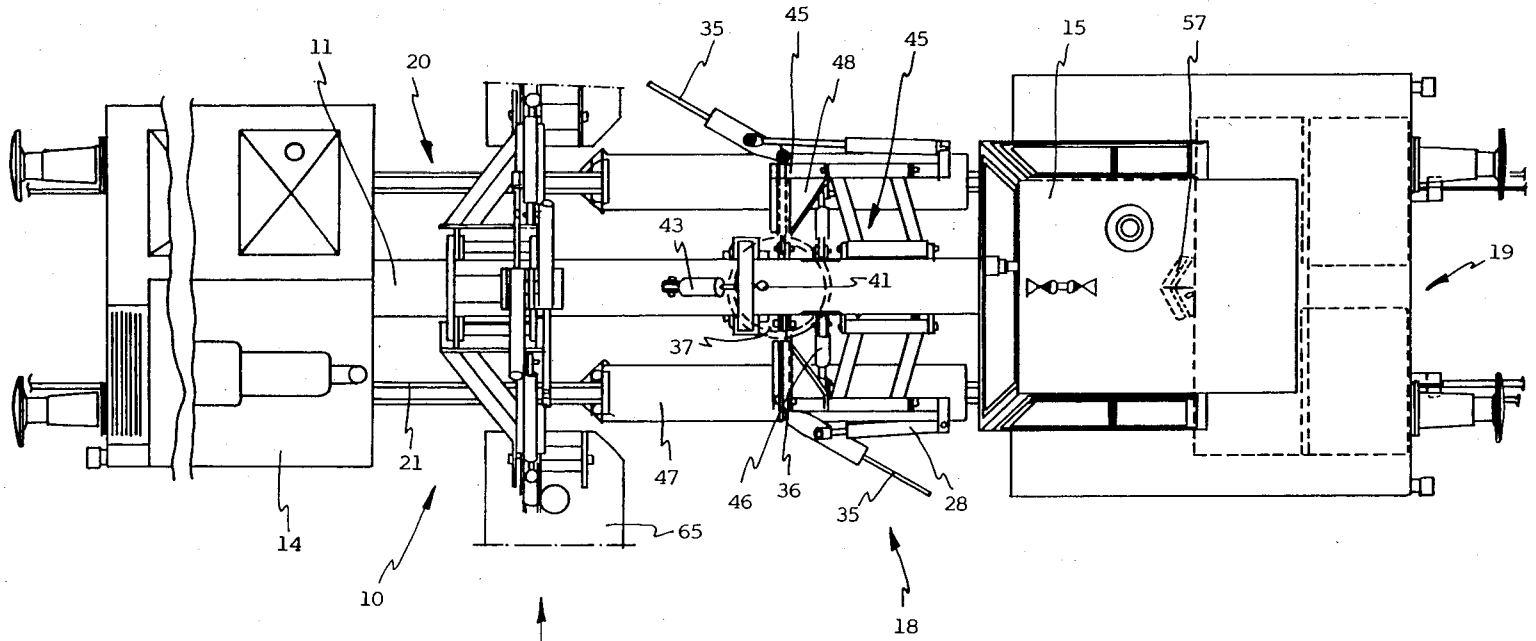
FIG. 2 is a plan view of the same machine.

In FIGS. 1 and 2 a ballast dressing machine 10 comprises a frame 11 consisting of one single beam, preferably of a box-type, in this case. As can be seen in particular in the plan view of FIG. 2, this embodiment enables a driver 16, lodged in a cab 15 with windows, to supervise visually the operations of dressing and re-distributing the metalling in an excellent manner.

The frame 11 supports on its front portion a motor 14 that supplies motion to front wheels 12, which are drive wheels in this case.

The frame 11 comprises also a rear axle 13 which too can be a drive axle or possibly can be an idler axle.

The lower part of the machine 10 comprises three separate work units. Looking from the front to the rear of the machine 10 it is possible to see a dressing unit 17 according to the invention, a central re-distributing unit 18 and lastly a brush unit 19.

A dressing unit 17 has the task of shaping the portions of ballast at the side of a railway line 20 according to the required geometrical conformation. This unit 17 according to the invention is shown in greater detail in FIG. 3.

Figure 3:
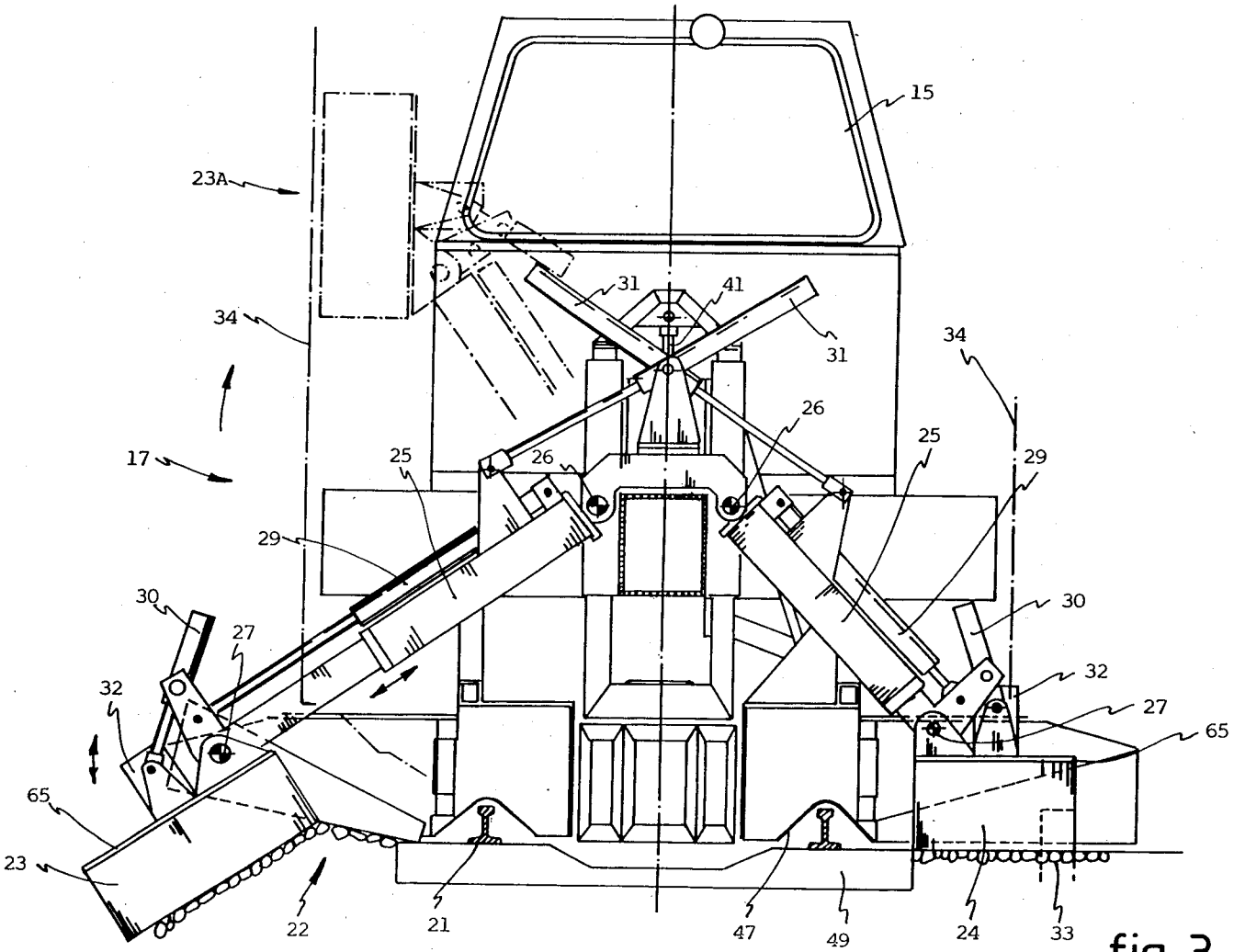
FIG. 3 shows a view along the cross section A—A of FIG. 1.

FIG. 3 shows a rotary drum 23 and a rotary drum 24 comprised respectively on the two sides of the machine 10. These drums 23–24 have independent drives and therefore the driver 16 can work with only one of them or with both of them, as required. During normal functioning both the drums 23–24 will work advantageously.

These drums 23–24 may be equipped with suitable frontal and/or peripheral elements, such as blades, teeth or other elements, which can distribute the metalling of which the road bed ballast 22 consists.

Figure 4:
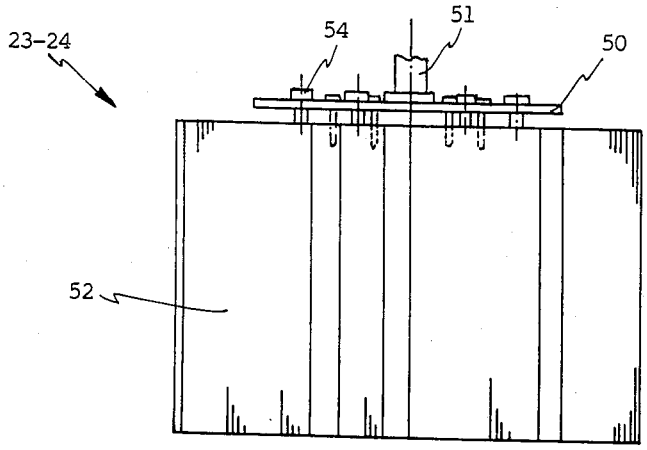
FIGS. 4 and 5 show in detail a ballast dressing drum.
Figure 5:
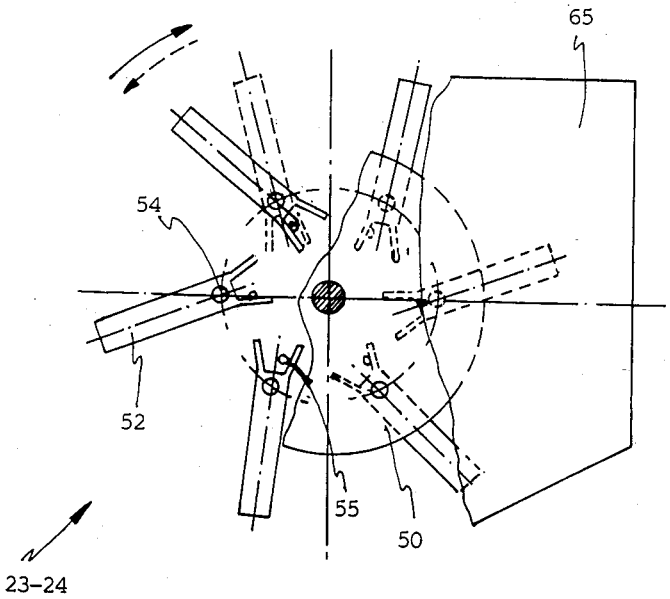

FIGS. 4 and 5 show a preferred embodiment of such drums 23–24. In these figures the drum 23 or 24 comprises in its upper portion a disk or support element 50 keyed to a drive shaft 51 of a motor 32 (see FIGS. 1 and 2).

In the example of FIG. 4 a plate 65 has been removed, but a part of it is shown in FIG. 5.

The disk 50 supports a plurality of elements 52 to engage the metalling, such elements being blades in the example shown. Such blades 52 can rotate about pivots 54 and are equipped with abutments 55.

In this way, depending on whether the drum 23–24 rotates in one or the other of the directions indicated by the arrows, the blades will be positioned at an angle on one side or the other in relation to the radial direction, the purpose of this being to prevent retention of the metalling by the blades 52.

In fact, there is a centrifugal effect of discharge of the metalling engaged, this effect being due to the inclination of the blades 52.

The abutments 55 may possibly be arranged to be adjustable so as to obtain various inclinations of the blades 52.

In the embodiment shown the blades 52 are supported at one end on the disk 50, but in a variant which is not shown here it is possible to arrange that the blades 52 are supported also on the lower end of the drum 23–24. In this way, instead of being supported only at one end, the blades 52 are supported at two pivots points, one on the upper disk 50 and one on a lower support, the whole assemblage thus obtaining greater rigidity and strength.

Such lower support may have the form of a disk or a polygonal shape or be formed with spokes and will extend preferably in a radial direction a little beyond the pivot point 54 of the blades 52.

The blades 52 may possibly have a stepped profile at their lower end so as to protrude downwards beyond the lower support.

In the example shown the rotary drums 23–24 have different diameters. The smaller drum 24 is suitable for employment on the portion of ballast between two neighbouring railway lines 20, namely where two or more lines run parallel to each other, the purpose being to avoid without difficulty, by sideways displacement, the pickets that mark the line, which are indicated with 33 in FIG. 3, this being a thing which cannot be performed easily with a large drum.

Moreover, in its working position the drum 24 always stays within the maximum overall working bulk laid down in the regulations and thus does not come into contact with trains passing on the neighbouring line.

As can be seen, the drum 23 or 24 is supported by a support plate 65, which in turn is supported rotatably at 27 by a telescopic arm 25 that can be extended by an actuator 29, which in this case is a jack.

The arm 25 in turn is pivoted at 26 and can be rotated by an actuator 31, which is also a jack in the example shown.

The drum 23 or 24 can be adjusted for inclination by being rotated about the pivot 27 by an actuator 30, which here is also a jack. The adjustment capability of the two drums 23–24 is the same.

It will perhaps be possible, advantageously in the case of one single railway line, to fit drums 23–24 having the same diameter.

The top lefthand corner of FIG. 3 shows with lines of dashes a position 23A for the drum 23 when being transported from one area to another. Such position 23A lies within the maximum overall bulk permitted during transport, such bulk being shown with lines of dots and dashes 34.

The ability of the drums 23–24 to be adjusted as regards inclination, height and lateral extension according to the invention, such drums working advantageously at one and the same time, makes easy the formation of any profile of the ballast 22 at the side of the line 20.

The drums 23–24 may comprise advantageously at least a partial cover to prevent an upheaval of metalling and too great a production of dust. Such cover may, for instance, be fixed solidly to the plate 65 and extend sideways or also backwards from the drum 23–24.

The lower part of such cover can be made of rubber or another resilient material so as to fit against the ballast and thus keep the lifting of dust to a minimum.

The dressing unit 17 of the machine shown cooperates with a re-distributing unit 18, which comprises two orientable ploughs 35, each of which is rotatably supported on an axis 36 by a support element 48 having a box-type structure in this example.

Actuators 28, which in this example consist of jacks, enable each plough 35 to be rotated about its axis 36 so as to obtain a desired foward or backward orientation of the ploughs 35 (see FIG. 2).

The ploughs 35 can be the same as each other or have different shapes, depending on the profile to be imparted to the ballast and on the specific requirements.

Vertical adjustment of the ploughs 35 is obtained by raising or lowering the elements 48. Each element 48 is connected to the frame 11 of the machine 10 by means of arms 45 arranged as a parallelogram. An actuator 46, here a jack, performs adjustment of height of the element 48.

As we said in the first part of this description, bridge elements 47, which are shown also in FIGS. 1 and 2, serve to enable the metalling lifted by the ploughs 35 to be transferred to and from the inner part of the line 20 by passing over the rails 21.

Adjustment of both the inclination and the height of the central ploughs 35 is carried out directly by the driver 16, who supervises from his cab 15 with windows the operation of re-distributing the metalling.

A transfer drum 37 is located at the centre of the machine 10 between the two support elements 48 and is arranged so as to be able to rotate and to be supported by a support structure 40, which can slide vertically within guides 44.

Adjustment of the height of the structure 40 and therefore of the transfer drum 37 is performed by an actuator 41, which also consists of a jack in this case.

The guides 44 can pivot on an axis 42 in relation to the frame 12; in this way the guides 44 and therewith the sliding structure 40 can be oriented so as to tilt the drum 37 in relation to the vertical when so required. Such orientation is performed by an actuator 43, which in this case is a jack.

In this way is obtained an in-depth working effect of the drum 37, which has a working surface that is no longer flat but is convex towards a sleeper 49, thus fitting the recessed shape of the sleeper.

Thus the drum 37 can scrape and move the metalling in the central portion of the sleeper 49. This is particularly useful for recessed concrete sleepers.

Such scraping of the metalling facilitates the brushing work in the central zone of a railway line.

The combined action of the ploughs 35 and drum 37 in cooperation with the bridge elements 47 enables the ballast to be removed from one side of the line to the other in one single pass.

In the example shown the brush unit 19 comprises a rotary brush 53 cooperating with a central cleaner means 57, which in this example consists of a central plough specially adapted for bi-block sleepers.

The height of the cleaner 57 can be adjusted by means of an actuator 58, which is also a jack in this case.

The metalling thrown up and lifted by the plough 57 is collected thereafter by the brush 53. The metalling thrown up by the rotary brush 53 falls onto a chute 60 and is removed laterally by a conveyor or chute 59.

A rotary brush of a small size, which is not shown here, may possibly by provided instead of the plough 57. Such brush will advantageously be adjustable in height by the jack 58 independently of the rotary brush 53.

A stationary brush 61 to clean the zone of the attachments can also be seen (FIG. 1) at the extreme end of the machine 10. This brush 61 is kept in position by an actuator 62, such as a jack or electromagnetic actuator.

The rotary 53 and stationary 61 brushes and also the plough 57 are raised when the machine moves to another area.

We have described here a preferred embodiment of this invention, but many variants are possible without departing thereby from the scope of the invention itself.

Thus the shapes and sizes of the parts can be changed as also can the positions of the work units; the actuators can be replaced with equivalent means of a pneumatic, hydraulic, mechanical, electromagnetic, etc. type.

These and other variants are all possible for a person skilled in this field without departing thereby from the scope of the invention.

INDEX

10—a ballast dressing and re-positioning machine
11—frame
12—front wheels and axle
13—rear axle
14—motor
15—cab
16—driver
17—lateral dressing unit
18—central re-distributing unit
19—brush unit
20—railway line
21—rails
22—road bed ballast
23—dressing drum
23A—transport position
24—dressing drum
25—telescopic arm
26—pivot
27—pivot
28—actuator or jack
29—actuator or jack
30—actuator or jack
31—actuator or jack
32—motor
33—pickets
34—maximum overall bulk
35—ploughs
36—axis
37—rotary transfer drum
39—motor
40—support structure
41—actuator or jack
42—axis of rotation
43—actuator or jack
44—guides
45—parallelogram arms
46—actuator or jack
47—bridge elements
48—support element
49—sleeper
50—disk or support element
51—drive shaft
52—elements or blades to engage metalling
53—rotary brush
54—pivots
55—abutments
57—central cleaner means 58—actuator or jack
59—conveyor or chute
60—chute
61—stationary brush for zone of attachments
62—actuator
63—support plate.

I claim:

1. A machine for dressing and distributing railway road bed ballast, comprising a frame having forward and rear ends;

wheels for supporting the frame and engaging rails of a railway;

a dressing unit located near the front end of the frame, comprising:

first and second support arms extending laterally from opposite ends of the frame, vertically adjustable with respect to the frame, each arm extending a variable distance outwardly from the frame; and first and second rotary lateral dressing drums pivotably secured to the first and second support arms for shaping ballast at the sides of a railway, said dressing drums comprising rotatably mounted blades, said blades comprising engaging means, the drums comprising means cooperating with the engaging means to allow the blades to take one of two distinct positions depending on the direction of rotation of the drums;

a redistributing unit located rearwardly of the dressing unit, comprising:

third and fourth support arms extending laterally from opposite sides of the frame, vertically adjustable with respect to the frame;

first and second ploughs pivotably secured to the third and fourth support arms, said ploughs being pivotable in a horizontal direction;

a drum support, tiltable in a longitudinal direction with respect to the frame;

a transfer drum carried by said support, said transfer drum being vertically adjustable with respect to the frame, oriented to have a vertical axis which is tiltable with the drum support, and disposed beneath the frame and between the first and second ploughs; and bridge elements for overlying rails of a railway to facilitate transfer of ballast over the rails; and a brush unit located rearwardly of the redistributing unit, comprising:

a central cleaning unit vertically adjustably secured to the frame, disposed beneath the frame;

a rotary brush for engaging material thrown up by the central cleaning unit, said rotary brush having a substantially horizontal axis; and a chute means for collecting material engaged by the rotary brush.

2. The machine of claim 1, further comprising drive means allowing independent operation of the first and second dressing drums.

3. The machine of claim 1, wherein the dressing drums are of different diameter.

4. The machine of claim 1, wherein the central cleaning unit comprises a plough.

5. The machine of claim 1, wherein the central cleaning unit comprises a brush.

6. The machine of claim 1, wherein the brush unit further comprises a stationary brush to clean the attachments of a railway.

7. The machine of claim 1, wherein each dressing drum rotates about an axis substantially perpendicular to the ballast being shaped by the drum.

* * * * *

UNITED STATES PATENT AND TRADEMARK OFFICE

CERTIFICATE OF CORRECTION

PATENT NO. : 4,706,395

DATED : November 17, 1987

INVENTOR(S) : Ivo Cicin-Sain

It is certified that error appears in the above-identified patent and that said Letters Patent is hereby corrected as shown below:

Title page:

In the Assignees, please change "ITI/CLM Impianti Technici Industriali SpA" to --ITI/CLM Impianti Tecnici Industriali SpA--.

Signed and Sealed this

Nineteenth Day of April, 1988

*Attest:*

*Attesting Officer*

DONALD J. QUIGG

*Commissioner of Patents and Trademarks*